United States Patent [19]

White

[11] 3,964,495

[45] June 22, 1976

[54] SMOKING COMPOSITIONS

[75] Inventor: Jackie L. White, Pfafftown, N.C.

[73] Assignee: R. J. Reynolds Tobacco Company, Winston-Salem, N.C.

[22] Filed: Apr. 15, 1974

[21] Appl. No.: 460,782

[52] U.S. Cl. ..... 131/17 R; 131/2; 131/140 C; 131/140 P

[51] Int. Cl.[2] ..... A24B 3/14; A24B 13/00; A24B 15/08

[58] Field of Search ..... 131/2, 17 R, 140 P, 131/140 R, 140–144, 15

[56] References Cited

UNITED STATES PATENTS

| | | | |
|---|---|---|---|
| 52,976 | /1866 | Dawson | 131/17 R |
| 2,922,355 | 1/1960 | Green | 131/140 P X |
| 3,100,492 | 8/1963 | Schmidt | 131/17 R |
| 3,106,209 | 10/1963 | Torigian | 131/17 R X |
| 3,409,023 | 11/1968 | Burde | 131/140 P |

FOREIGN PATENTS OR APPLICATIONS

| | | | |
|---|---|---|---|
| 687,507 | 3/1967 | Belgium | 131/2 |

OTHER PUBLICATIONS

"The Chemical Comp. of Tobacco" by Stedman, p. 190, East. Utiliz. Res. Service, USDA Penn. 19118 Reviewed 10/18/67.

Shmuk vol. 3 of "The Chem. & Tech. of Tob." pp. 602–603, Pub. by Pischhpromizdat Moscow, 1953.

"Dangerous Prop. of Indust. Mat." by Sax, 3rd Edit., p. 461, 1968, Pub. by Reinhold Publ.

"No Smoking?" Evening Star, Aug. 27, 1963, p. A8.

*Primary Examiner*—Robert W. Michell
*Assistant Examiner*—V. Millin
*Attorney, Agent, or Firm*—Neuman, Williams, Anderson & Olson

[57] ABSTRACT

Popped corn is used alone or with tobacco to provide smoking materials.

11 Claims, No Drawings

SMOKING COMPOSITIONS

This invention relates to novel smoking compositions and to products derived therefrom.

It is a principal object of this invention to provide a composition of matter which is advantageous for use as a smoking material.

It is another object of this invention to provide novel compositions containing tobacco which compositions can be used to form products such as cigarettes, cigars, pipe tobacco and the like.

The present invention involves the discovery that corn (maize) which is in an expanded condition and of relatively low density is eminently suitable for use as a smoking material.

In one embodiment, the invention provides smokable compositions comprising a mixture of tobacco and popped corn. The popped corn serves as a tobacco extender without significant effect on the organoleptic properties of tobacco products in which it is present. In a second embodiment of the invention, popped corn is used alone or with other non-tobacco materials to form smoking materials.

The corn (maize) which is utilized as a smoking material in accordance with this invention is corn (*Zea mays*) which has been processed to expand its volume and decrease its density whereby it is in an expanded condition supportive of combustion. The ability to pop (volume expansion) varies among types of corn with popcorn (*Zea mays everta* (Sturt.)) being the type exhibiting the greatest ability to pop. For example, the popping ability of flint corns is generally less than popcorn and still less for dent corns. Even among the popcorns there is a wide variation in the degree and completeness of popping which some believe to be dependent upon the proportion of hard starch present. Because of its popping ability, the preferred type of corn to employ in accordance with this invention is popcorn (*Zea mays everta* (Sturt.)), however, any type of corn which can be expanded so as to produce a material having a relatively low density can be used. Thus, in its broad aspects, the present invention involves the use of any species or botanical variety of corn, including hybrids, provided that the popped corn exhibits the desired low density. In general, the bulk density of the popped corn employed herein is not greater than about 0.40 gram per cubic centimeter and preferably not greater than about 0.20 gram per cubic centimeter. The expression "popped corn" as used herein means the kernels of any type of *Zea mays* which have been expanded to such extent that the bulk density is not greater than 0.40 gram per cubic centimeter when determined on a 12-mesh sample. For this determination of bulk density the corn is ground in a suitable mill and sieved to recover the 12-mesh (U.S. Sieve series) portion thereof with a uniformly packed sample of known volume then being weighed.

The volume expansion of corn can be accomplished by conventional procedures, such as by rapidly heating corn kernels to cause them to pop. It is believed that the moisture content of corn determines the popping ability of corn. Heating popcorn having a moisture content of about 11 to 15% by weight to temperatures on the order of about 350° to 550° F. generally results in good volume expansion (reduction in density) with the popped material being combustible. It is, of course, desirable from an economy standpoint to use popping techniques which provide the maximum amount of expansion. After popping, the popped corn is separated from unpopped kernels by conventional procedures such as screening, air classification and the like. The size and shape of the popped corn which is used to form smoking materials is primarily dependent upon its intended use. It is generally preferred to grind, or more preferably shred, or otherwise comminute the popped corn to a size and shape approximating that of the tobacco with which it is employed. Removal of the hull from the popped corn to the extent possible is also desirable. Thus, when employed with tobacco to form cigarettes, the popped corn is cut, sliced or shredded to a size and shape similar to the filler tobacco employed therewith. It is preferred to do likewise when the popped corn is used with tobacco to form cigars or pipe smoking compositions.

When used with tobacco, popped corn is blended with tobacco and the blend is then processed in conventional manner to form tobacco products. For example, popped corn is shredded to a size approximating that of cut filler tobacco with which it is blended in desired proportion. The blend is then processed in conventional cigarette making machines to form cigarettes which can be either of the filter or non-filter type. Additive materials such as flavorants, humectants, ash improvers, combustion modifiers, fillers and the like can be incorporated with the tobacco/popped corn blends. Pipe or smoking tobacco products can be readily produced by simply blending the popped corn with tobacco and flavorants, if any.

It will be appreciated that the use of popped corn with tobacco serves to extend the tobacco or reduce the amount of tobacco employed in a product with a concommitant decrease in the amount of nicotine therein. This is achieved without adverse effect on the taste or aroma of the final product. The amount of the popped corn which is blended with tobacco can vary widely up to about 50% or more by volume of the tobacco.

According to a second embodiment of the invention, popped corn is employed as a tobacco substitute by itself or with other non-tobacco materials to form smoking products such as cigarettes, cigars and pipe smoking products. When so used, it is presently preferred that the popped corn simulate tobacco and accordingly appropriate procedures can be employed to provide the popped corn in desired size and shape. The burning rate, flavor and other properties of non-tobacco smoking products can be altered by incorporating with the popped corn suitable additives such as flavorants, tobacco extracts, nicotine, humectants, ash improving additives, etc. The burning rate of popped corn is somewhat faster than most natural tobaccos and accordingly, to decrease the burning rate of non-tobacco smoking products, suitable filler materials or combustion modifiers such as magnesium carbonate, calcium carbonate, potassium carbonate, sodium carbonate, magnesium nitrate, calcium nitrate and the like can be incorporated with the popped corn. The materials which are used with the popped corn to form smoking products are employed in amounts depending upon the effects desired.

When used with or without tobacco to form smoking materials, the popped corn is preferably conditioned to a moisture content of say from 6 to 15% at which moisture content the material is well adapted for processing to form smoking products. At a moisture content below about 2%, popped corn tends to be somewhat friable and less suitable for processing as, for example, in cigarette making machines.

The following examples illustrate the advantages of the present invention. In the examples the bulk density of the tobacco extender of this invention was determined by weighing a known volume of the expanded corn as indicated. However, in all cases the bulk density of the materials is less than 0.40 gram per cubic centimeter when determined on a 12-mesh sample thereof.

EXAMPLE 1

Popped corn was ground on a Wiley mill with a 20-mesh screen in place. The ground popped corn which passed through the 20-mesh screen was collected and found to have a bulk density of 0.12 gram per cubic centimeter. It was observed that when unground or ground popped corn was ignited with a match, the resulting combustion was with flame and no visible smoke. The ground, popped corn was mixed with a commercial cigarette tobacco blend in a 50–50 by volume proportion. This mixture was hand rolled into cigarettes. These cigarettes were smoked and evaluated as delivering less smoke and sting than similar all tobacco cigarettes.

EXAMPLE 2

A hexane extract of flue cured tobacco was obtained. Following concentration of the extract by removal of the hexane, the extract was dissolved in ethanol and was applied to shredded popcorn having a bulk density of 0.05 gram per cubic centimeter. The ethanol was then allowed to evaporate from the treated popcorn. The amount of extract obtained from 1 gram of tobacco was sprayed on 1 gram of shredded popcorn. The treated popcorn was blended with reconstituted tobacco made from tobacco fines. The blend composition was 75% shredded popcorn and 25%, by volume, tobacco. Using this blend, cigarettes were made on a Haunibaby cigarette machine using Ecusta Ref. 856 rod paper. Upon evaluation, smokers commented that the test cigarettes burned satisfactorily and were definitely smokable with a lower level of irritation than cigarettes composed entirely of the reconstituted tobacco.

EXAMPLE 3

Shredded popcorn having a bulk density of 0.05 gram per cubic centimeter was blended with a commercial pipe tobacco. One blend contained 12.5% shredded popcorn by volume and the other blend contained 25% (by volume) shredded popcorn. Expert pipe smokers evaluated the blends with the following comments:

No difference between the commercial pipe tobacco and the blend containing 12.5% popcorn.

The blend with 25% popcorn seemed slightly milder but had no off-taste.

Both blends had less bite than the commercial pipe tobacco.

EXAMPLE 4

Commercial cigarettes were cut open and the tobacco was removed. A quantity of this tobacco, 171.4 grams, was extracted with ethyl alcohol with the alcohol being subsequently removed to yield 46.8 grams of extract. This extract was then put into solution with 500 milliliters of ethyl alcohol. Approximately 55 milliliters of this extract in alcohol solution was mixed with 265 milliliters of ground popped corn. The size of the ground popped corn was that which passed through a 10-mesh screen but was retained on a 20-mesh screen and its measured bulk density was 0.065 gram per cubic centimeter. The alcohol was allowed to evaporate from the mixture over a period of several days. This left a brown coating of tobacco extract on the ground popped corn.

The coated popped corn was then mixed in a 50–50 by volume proportion with the same commercial cigarette tobacco from which the extract was obtained. This mixture was rolled into cigarettes on a Top hand operated device, using Top cigarette paper. These cigarette rods were placed on cellulose acetate fiber filters. The completed cigarettes were panel tested and were found to be very smooth, non-irritating, free from nasal sting and very flavorful.

EXAMPLE 5

Bulk density measurements were made on whole popped corn which had been previously stored at 50 to 60% relative humidity until an equilibrium moisture content of 8 to 10% was reached. The popped corn was then ground in a Waring blender and sieved. Various particle sizes were collected and the bulk densities thereof were determined by weighing a 50 cubic centimeter volume of uniformly packed material. The packing was accomplished by wrapping the bottom of the container frequently during the packing operation so that the particles settled evenly. No external pressure was applied to the mass of particles in making this measurement. The densities of the materials retained on various mesh screens are shown in Table I. For comparison purposes, the densities of whole popped corn and selected tobacco materials are shown in Table II.

TABLE I

| Material Retained on U.S. Standard Sieve Series | Bulk Density |
|---|---|
| No. 8 | 0.0506 g/cc |
| No. 12 | 0.0552 g/cc |
| No. 14 | 0.0638 g/cc |
| No. 16 | 0.0707 g/cc |
| No. 20 | 0.0824 g/cc |
| No. 30 | 0.1181 g/cc |

TABLE II

| Sample | Bulk Density |
|---|---|
| Whole Popped Corn* | 0.025 g/cc |
| Puffed Flue-Cured Tobacco** | 0.07 g/cc |
| Reconstituted Tobacco | 0.19 g/cc |
| Commercial cigarette blend without casing or top dressing | 0.11 g/cc |

*Determined on 4,000 cubic centimeter sample
**Puffed in accordance with U.S. Pat. No. 3,524,451

These tests demonstrate that the popcorn smoking material is highly expanded and low in bulk density when compared to tobacco commonly used for filling cigarettes.

EXAMPLE 6

The filling capacity of two samples of popped corn was determined. One sample constituted 12-mesh particles and the other sample was shredded popped popcorn. The shredded popped popcorn was cut in 32 shreds per inch and was very much like tobacco shreds.

In order to measure the filling capacity of a cigarette filler material, a measuring device is used which is essentially composed of a 100 milliliter graduated cylinder having an internal diameter of about 25 millimeters and a piston having a diameter of about 24 millimeters and weighing about 802.5 grams slidably positioned in the cylinder. A 3 gram sample of the material is placed in the cylinder and the piston positioned on it. The gravitational force exerted by the piston corresponds to a pressure of about 2.3 pounds per square inch. The filling value of the sample is the volume to which the 3 gram sample of the material in the cylinder is compressed after the weight of the piston has acted on it for a period of 3 minutes. This pressure corresponds closely to the pressure normally applied by the wrapping paper to the tobacco in cigarettes. The moisture content of the tobacco affects the filling capacities determined by this method. Therefore, comparative filling capacities were obtained at similar moisture contents. By this procedure the filling capacity of the two samples of popped corn is shown in Table III.

TABLE III

| Days Conditioned at 65% Relative Humidity | 12-Mesh Sample % moisture | 12-Mesh Sample Filling capacity ml/3g | Shredded Sample % moisture | Shredded Sample Filling capacity ml/3g |
|---|---|---|---|---|
| 0 | 6.56 | 43.3 | 9.66 | 45.5 |
| 1 | | | | |
| 2 | | | | |
| 3 | 8.64 | 46.5 | 9.85 | 44.8 |
| 4 | 9.75 | 45.0 | 10.76 | 44.3 |
| 5 | | | | |
| 6 | | | | |
| 7 | | | | |
| 8 | 10.05 | 43.3 | 12.64 | 44.0 |

The results show that although percent moisture did increase over a period of 8 days, the filling capacity of the popped corn tobacco extender remained almost unchanged. Using the same test procedure, flue-cured tobacco of 12.6% moisture content which had been puffed (filling capacity increased) in accordance with U.S. Pat. No. 3,524,451 was found to have a filling capacity of about 29 ml/3g.

EXAMPLE 7

Whole popped popcorn was shredded. The approximate size of the popcorn shreds obtained was as follows: Width — 0.03 inch to 0.04 inch, thickness — 0.03 inch to 0.07 inch, length — 0.08 inch to 0.70 inch. Bulk density of the shreds was 0.05 gram per cubic centimeter.

The popcorn shreds were blended with a commercial cigarette tobacco in various proportions. Cigarettes were made on a Haunibaby cigarette making machine. The cigarette rod paper used was Ecusta Ref. 856. The rods were tipped with a 20 millimeter length of 3.3/39,000 cellulose acetate fiber filter. The completed cigarettes were 85 millimeters long and 25 millimeters in circumference. The following table shows the blend composition and rod weight.

TABLE IV

| Sample | % By Volume POPCORN | % By Volume TOBACCO | Rod Wt. grams |
|---|---|---|---|
| 1 | 0 | 100 | .83–.87 |
| 2 | 6 | 94 | .79–.83 |
| 3 | 12.5 | 87.5 | .74–.78 |
| 4 | 25 | 75 | .66–.70 |
| 5 | 50 | 50 | .48–.52 |

Taste tests were conducted on the blend containing all tobacco and on the blend containing 12.5% (by volume) popcorn. Smokers commented that there was no difference in taste and that the popcorn blend was slightly milder.

EXAMPLE 8

Popped popcorn was obtained and conditioned to approximately 8.5% moisture and shredded. The shreds were approximately 0.05 inch × 0.45 inch with a bulk density of 0.05 gram per cubic centimeter. These shreds were blended with a commercial cigarette tobacco at various extender levels. The rod paper was Ecusta Ref. 556. The rods were made to a length of 65 millimeters on the Haunibaby cigarette making machine. The rods were later tipped with 20 millimeters of 3.3/39,000 cellulose acetate filters.

Rod Specifications

| Volume % Extender | | *Rod Weight (grams) |
|---|---|---|
| 0 | (All Tobacco) | .83–.87 |
| 6.0 | | .79–.83 |
| 12.5 | | .74–.78 |
| 25.0 | | .66–.70 |
| 50.0 | | .48–.52 |

*65 millimeter rod without filter

Smoke Analysis

| Sample | TPM* (mg) | Nicotine** (mg) | TPM*Water (mg) | FTC** Tar (mg) |
|---|---|---|---|---|
| All Tobacco | 25.7 | 1.46 | 4.9 | 19.3 |
| 6% Extender | 23.0 | 1.27 | 3.4 | 18.3 |
| 12.5% Extender | 21.5 | 1.08 | 3.8 | 16.7 |
| 25.0% Extender | 20.6 | .92 | 3.9 | 15.8 |
| 50.0% Extender | 18.2 | .55 | 3.7 | 13.9 |

*Total Particulate Matter
**As determined by standard procedures of Federal Trade Commission.

EXAMPLE 9

A solution of 1.73 grams of magnesium nitrate hexahydrate in 5 milliliters of water was sprayed onto 19 grams of shredded popped popcorn. The popcorn was then treated in a similar manner with a solution of 0.5 gram potassium carbonate in 4 milliliters of water. The treated popcorn was allowed to air-dry and was then made into 70-millimeter cigarettes using a small Hauni cigarette making machine and Ecusta 853 paper. The average weight of the cigarettes was 0.38 gram and the average pressure drop across the 70-millimeter rod was 3.25 inches of water. The average number of puffs obtained from each cigarette when machine smoked under standard FTC conditions (i.e., one 35-milliliter puff of 2-second duration every 60 seconds until a butt length of 23 millimeters is reached) was 4.2.

The use of popped corn with tobacco to produce useful products possesses numerous advantages. Thus, use thereof permits a significant reduction in the utilization of tobacco. Not only is the use of less tobacco in a tobacco product obviously advantageous from an economic standpoint, but the reduction of nicotine in such products may be highly desirable. The reduction of so-called "tars" may also be realized through the use of popped corn in smoking products since particulate matter produced per unit volume of popped corn is substantially less than that for tobacco due to the significantly lower density of popped corn. The nicotine-free popped corn, when blended with tobacco, does not cause adverse effects on the quality of the final product. The popped corn is easily processed, readily available at relatively low cost and does not detract from the taste or aroma of the tobacco product. The popped corn is non-friable in nature, does not collapse as a cigarette is smoked nor does it hinder combustion or puffing of cigarettes in which it is employed.

Those modifications and equivalents which fall within the spirit of the invention are to be considered a part thereof.

What is claimed is:

1. A smoking material which contains comminuted popped corn in a form resembling cut cigarette filler tobacco or cut pipe tobacco.

2. A smoking material in accordance with claim 1 wherein the popped corn is in the form of shreds.

3. A smoking material in accordance with claim 1 which also contains tobacco.

4. A smoking material in accordance with claim 3 wherein the popped corn is employed in an amount up to 50% by volume of the tobacco.

5. A cigarette whose filler contains comminuted popped corn in a form resembling cut cigarette filler tobacco.

6. A cigarette in accordance with claim 5 wherein the popped corn is in the form of shreds.

7. A cigarette in accordance with claim 5 whose filler also contains tobacco.

8. A cigarette in accordance with claim 7 wherein the popped corn is employed in an amount up to 50% by volume of the tobacco.

9. A process of preparing a cigarette which comprises wrapping with a cigarette paper a filler material containing comminuted popped corn in a form resembling cut cigarette filler tobacco.

10. A process in accordance with claim 9 wherein the popped corn is in the form of shreds.

11. A process in accordance with claim 9 wherein said filler material also contains tobacco.

* * * * *